United States Patent [19]

Closser et al.

[11] Patent Number: 4,974,851

[45] Date of Patent: Dec. 4, 1990

[54] GOLF CLUB IMPACT MAKING DEVICE AND METHOD

[76] Inventors: Daniel P. Closser; Patricia P. Closser, both of 7667 Callaghan Rd., #201 San Antonio Tex. 78229

[21] Appl. No.: 465,930

[22] Filed: Jan. 16, 1990

[51] Int. Cl.[5] ..... A63B 69/36

[52] U.S. Cl. ..... 273/186 D; 273/26 B

[58] Field of Search ..... 273/186 D, 183 D, 186 C, 273/186 R, 26 R, 26 B, 29 A

[56] References Cited

U.S. PATENT DOCUMENTS 2,660,436 11/1953 Grossman ..... 273/186 D 3,754,764 8/1973 Manherk ..... 273/186 D

FOREIGN PATENT DOCUMENTS 2092010 8/1982 United Kingdom ..... 273/186 D 2171019 8/1986 United Kingdom ..... 273/186 D

*Primary Examiner*—George J. Marlo

*Attorney, Agent, or Firm*—Thomas E. Sisson

[57] ABSTRACT

A method and apparatus for registering a point of impact of a ball against a surface of a hitting implement. A multilayered impact indicator is releasably affixed to the striking surface of the implement. Each of the layers of the indicator have identical indicia on them. The top and bottom layers of the indicator cooperate in a carbonless fashion such that when the ball impacts on the top layer, the impact is communicated to and registered on at least the second layer. The indicia on the top layers is arranged to be in corresponding alignment with the same indicia on the bottom layer. The indicia includes a centrally outlined or dispositioned target area or portion. The target is surrounded by other indicia indicating the closeness of the impact to the target.

4 Claims, 1 Drawing Sheet

GOLF CLUB IMPACT MAKING DEVICE AND METHOD

BACKGROUND OF THE INVENTION

The present invention relates to an athletic training apparatus and method, and more particularly to an apparatus and method for evaluating or measuring the position or location of a ball's impact on the face of a golf club. The invention is also applicable to evaluating or measuring the point of impact on any other striking implement such as a bat, racket, or stick.

Current techniques for measuring and evaluating the precise point of impact of a club face upon a golf ball principally involve the use of high speed photographs, films, and videos. Such techniques require the use of expensive equipment which must be transported to the training site and operated by someone other than the player who is practicing. While the usage of video equipment now allows the player to view the swinging technique soon after the practice stroke, resolution of video images often is not of sufficient clarity to enable the player to see where the point of impact actually occurs between the club face and ball. Even with high resolution, still photographs, the camera must be positioned dangerously close and nearly directly in front of the ball.

The present invention provides a simple apparatus and method for an unassisted player to receive immediate specific feedback on the precise location or point of the ball-club face impact. The invention provides a permanent record of that impact point which may be helpful in measuring trends the player is experiencing in making contact with the ball. The apparatus and method may be used on any club whether irons, woods, wedges, or putters.

The application of the present invention to measuring and registering the impact of a ball with other hitting-type implements is well within the scope of the present invention. For example, a baseball player may use the present invention to register the location of a ball impacting on his bat, or a tennis player may register the location of a tennis ball's impact on his racket.

SUMMARY OF THE INVENTION

The present invention is a method and apparatus for indicating the location of a ball's impact against a surface of a hitting implement. A multilayered impact indicator is releasably affixed to the striking surface of the implement. Each of the layers of the indicator have identical indicia on them. The top and bottom layers of the indicator cooperate in a carbonless fashion such that when the ball impacts on the top layer, the impact is communicated to and registered on the second layer. The indicia on the top layers is arranged to be in corresponding alignment with the same indicia on the bottom layer. The indicia includes a centrally outlined or dispositioned target area or portion. The target is surrounded by other indicia indicating the closeness of the impact to the target.

By affixing the indicator or marker of the present invention to the face of a hitting implement, then impacting a ball with the implement, followed by removal of the top layer of the indicator, the user is able to register and record the location of the ball's impact on the bottom layer of the indicator. Finally, the user may remove the bottom layer of the indicator from the implement and affix the bottom layer in a more permanent record book so as to preserve a history of the event.

DETAILED DESCRIPTION OF THE PREFERRED EMBODIMENT

Figure 1:
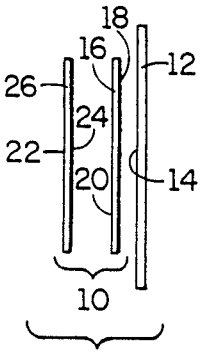
FIG. 1 illustrates a cross-sectional view of the apparatus of the present invention

FIG. 1 illustrates in a cross-sectional view the multilayered aspect of the present invention. A backing sheet 12 with a surface 14 suitable for easy removal of an adhesive or gummed label functions as a base for retaining and storing the impact marker or indicator 10 of the present invention until such time as the user removes the marker for placement on the face of the golf club or other hitting-type implement.

Figure 2:
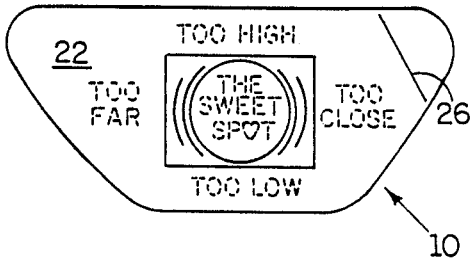
FIG. 2 illustrates the indicia on the top layer of the present invention for use with a golf club.

Affixed to backing sheet 12 is a read sheet or bottom sheet 16. A suitable adhesive 18 is applied to the back of sheet 16 to allow for easy removal from surface 14 of sheet 12 while still retaining sufficient tackiness to be capable of adhering to the face of a golf club as will be further discussed. Printed on the front surface 20 of read sheet 16 are locating or measuring indicia identical to that printed on face sheet 22. FIG. 2 illustrates the locating or measuring indicia 11 of the marker 10 as printed on face sheet 22; however, as previously stated, the identical indicia is also printed on the front surface 20 of read sheet 16.

Face sheet or top sheet 22 with suitable adhesive 24 on its back side is affixed to front surface 20 of read sheet 16 with the locating or measuring indicia of both sheets 22 and 16 in corresponding alignment. Surface 20 is suitable for easy removal of face sheet 22 without damaging or disrupting read sheet 16. Sheet 22 may be removed from sheet 16 by lifting along diagonal cut line 26, as will be discussed further.

Sheets 22 and 16 may be fabricated from materials commonly known as "carbonless" copy papers. Such materials enable a mark made with sufficient force on the top sheet to result in a corresponding mark on the second sheet. Even when no mark is made on the top sheet, if sufficient force is applied to the top sheet, a mark will register on the second sheet where the force was applied.

FIG. 2 illustrates a particular indicia 11 suitable for use with golf clubs. The ideal location to have the club impact the ball is often called "The Sweet Spot." This location is generally centered on the face of the club. Thus, the central portion 11A of the indicia of marker or indicator 10 is denoted "The Sweet Spot," and is in reality a target impact area. If the user strikes the ball with this target portion 11A of the indicia of the indicator 10, the read sheet 16 will register such impact as will be further discussed. The indicator 10 has additional indicia 11B which specifies the relative closeness of the location of impact to the target area as "too high", "too far", "too close", and "too low". With another hitting implement such as a baseball bat, in addition to "The Sweet Spot" (target) indicia 11A, other closeness locating or measuring indicia 11B such as "over", "under", "outside", and "inside" may be used.

Figure 3:
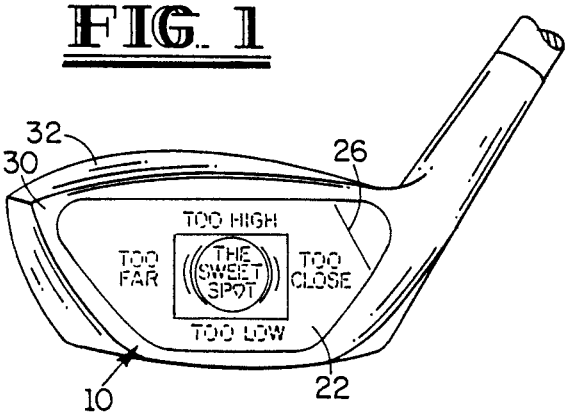
FIG. 3 illustrates the apparatus of the present invention affixed to the face of golf club prior to impact.
Figure 5:
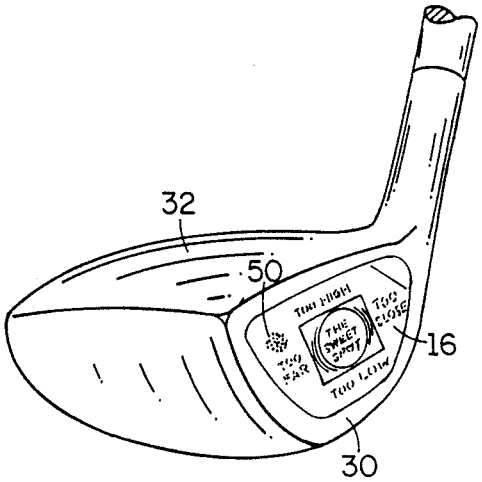
FIG. 5 illustrates the bottom layer of the present invention registering a ball's impact
Figure 4:
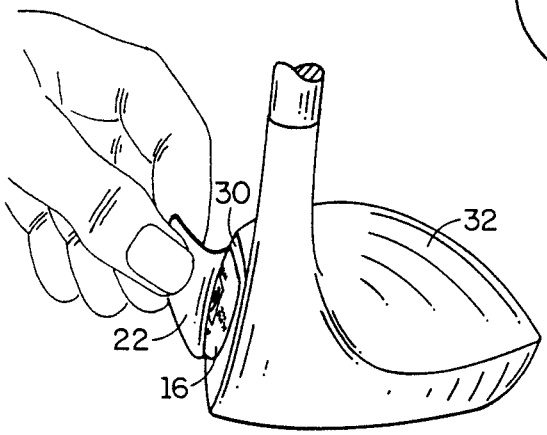
FIG. 4 illustrates the removal of the top layer of the present invention exposing the bottom layer after impact.

In the method of the present invention, trapezoidal-shaped indicator 10 is removed from backing sheet 12 by lifting read sheet 16 from backing sheet 12 and affixing indicator 10 to the face 30 of the golf club 32 or other hitting implement as shown in FIGS. 3–5. Because read sheet 16 has a tacky adhesive on its back side, sheet 16 sticks to the face 30 of club 32 as seen in FIG. 3

The user then strikes a ball with club 32 attempting to impact at "The Sweet Spot." After impact, the user removes the face sheet 22 by lifting along diagonal cut line 26 as shown in FIG. 3. Once face sheet 22 is removed, read sheet 16 is exposed and will reveal the exact location of impact, because the force of impact causes sheets 22 and 16 to interact and cooperate to register a mark 50 on read sheet 16. In FIG. 5 it may be seen that the location of impact mark 50 was "too far". To the user this will mean that he was standing too far from the ball, assuming all other factors in his club approach were correct.

The user then removes read sheet 16 from face 30 and places it in a separate record keeping book to provide him with a history of his training or practice. Normally, a marker is intended to be used once, i.e., one impact; however, a user may carefully re-affix face sheet 22 to read sheet 16 aligning the locating indicia and go through the impacting step again. This latter procedure is not recommended.

Alternate embodiments of the present invention may be suitable for training and registering the impact of a ball against other hitting implements such as bats, sticks, or rackets. In each embodiment, a multilayered impact indicator releasably affixable to a hitting implement is utilized. Each embodiment further utilizes locating or measuring indicia printed on the top surface of each layer of the indicator for indicating a target and the closeness of a ball's impact on the target (sweet spot) centrally located on the indicator.

While the invention has been described in connection with a preferred embodiment, it is not intended to limit the invention to the particular form set forth, but, on the contrary, it is intended to cover alternatives, modifications, and equivalents, as may be included within the spirit and scope of the invention as defined by the appended claims.

What is claimed is:

1. A method for registering a point of impact of a ball on a surface of a hitting implement comprising the steps of:

releasably affixing to said surface of said hitting implement a multilayered impact indicator including top and bottom layers, each of said layers having identical indicia thereon, said layers cooperating such that when said ball impacts upon a top layer of said indicator, said impact is communicated to and registered on at least said bottom layer of said indicator, said indicia on each of said layers in corresponding alignment with said indicia in all other of said layers, said indicia further comprising:

a centrally positioned target portion and a multiplicity of closeness portions surrounding said target portion;

impacting said ball against said multilayered impact indicator releasably affixed to said surface of said hitting implement; and removing said top layer of said indicator to expose said indicia on said bottom layer and a registration of said impact of said ball against said indicator affixed to said implement.

2. The method of claim 1 further comprising the steps of removing said bottom layer from said surface of said implement; and affixing said bottom layer to the surface of a permanent record.

3. An apparatus for registering a point of impact of a ball impact against a surface of a hitting implement comprising:

a multilayered impact indicator including top and bottom layers releasably affixable to said surface of said hitting implement, each of said layers having identical indicia thereon on each of said layers in corresponding alignment with said indicia in all other of said layers, said indicia further comprising:

a centrally positioned target portion and a multiplicity of closeness portions surrounding said target portion, said bottom layer including a releasable adhesive affixed to a back surface of said bottom layer;

said top layer including a releasable adhesive affixed to a back surface of said top layer, said top layer being releasably affixed to said bottom layer, said top and bottom layers cooperating such that when said ball impacts upon said top layer, said impact is communicated to and registered on at least said bottom layer.

4. The apparatus of claim 3 wherein said hitting implement is a golf club, said indicator is trapezoidal in shape, and said top layer of said miltilayered impact indicator has a diagonal cut line to facilitate removal of said top layer from a bottom layer.

* * * * *